United States Patent [19]

Yoshida

[11] Patent Number: 4,653,950

[45] Date of Patent: Mar. 31, 1987

[54] NONOXIDE CERAMIC BALL-POINT PEN BALL

[75] Inventor: Haruo Yoshida, Kyoto, Japan

[73] Assignee: Kyocera Kabushiki Kaisha, Kyoto, Japan

[21] Appl. No.: 774,162

[22] Filed: Sep. 6, 1985

Related U.S. Application Data

[63] Continuation of Ser. No. 436,775, Oct. 26, 1982, abandoned.

[51] Int. Cl.[4] ..... B43K 7/00

[52] U.S. Cl. ..... 401/215; 401/209

[58] Field of Search ..... 401/209, 215, 198, 199, 401/292; 75/236, 244; 29/149.5, 148.4 B, 148.4 R; 501/88, 90

[56] References Cited

U.S. PATENT DOCUMENTS

| | | | |
|---|---|---|---|
| 2,847,751 | 8/1958 | Reed | 29/148.4 B |
| 3,303,825 | 2/1967 | Shuman et al. | 75/236 |
| 3,520,630 | 7/1970 | Gordon et al. | 401/215 |
| 3,666,411 | 5/1972 | Collier | 401/215 |
| 3,746,456 | 7/1973 | Hill | 401/215 |
| 3,960,581 | 6/1976 | Cutler . | |

FOREIGN PATENT DOCUMENTS

| | | | |
|---|---|---|---|
| 739725 | 8/1966 | Canada | 401/215 |
| 3131538 | 2/1983 | Fed. Rep. of Germany | 401/209 |

OTHER PUBLICATIONS

"Hackh's Chem. Dic."; Grant, 1969 p. 611.

*Primary Examiner*—Richard J. Apley
*Assistant Examiner*—Gregory Beaucage
*Attorney, Agent, or Firm*—Spensley, Horn, Jubas & Lubitz

[57] ABSTRACT

This invention relates to a ball-point pen ball made of nonoxide ceramic and formed into a spherical body whose surface contains voids each having an average pore diameter of less than 75 μm and more than 0.1 μm. The ball thus made is not only almost free from "ball sunk", "nonuniformity in writing line thickness", "ball break", etc. but also excellent in affinity with ink and assures steady writing characteristic over a long period of time.

4 Claims, 1 Drawing Figure

NONOXIDE CERAMIC BALL-POINT PEN BALL

This is a continuation of copending application Ser. No. 436,775 filed on Oct. 26, 1982 abandoned.

BACKGROUND OF THE INVENTION

1. Field of the Invention

This invention relates to a ball-point pen ball in which is used a nonoxide ceramic material such as silicon nitride or silicon carbide.

2. Prior Art

It is mostly the case that balls used in ball-point pens are generally in the range of 0.4–1.2 mm in diameter. If so, suppose that an average person applies a writing load of 100–250 g to the ball-point pen in which is used a ball of 0.7 mm in diameter. The contact pressure applied to the ball seat of the ball-point pen is exceedingly high, amounting to as much as 40–60 kg/cm$^2$. Accordingly, too small a contact area of a ball adapted to be pressed into contact with a ball seat that is made of brass, stainless steel, plastics, etc. results in shaving of the surface of the ball seat by the surface of the ball.

On the other hand, the writing capability of a ball-point pen demanded from the pen during its service life amounts to a distance of about 1200–2200 m. If in this case a ball is 0.7 mm in diameter, it means that the ball revolves about one million times. Thus an important problem of wear of a ball seat involved. Accordingly, a reduction in the wear of the ball seat to the greatest possible degree involves a surface property of a ball as a very important element. Such surface property of the ball makes it necessary for ball composing materials to have the following characteristics:

(1) In order to reduce the pressure of contact of a ball with a ball seat, the component particles of ball material must be fine and uniform;

(2) In order to prevent reduction of contact pressure and shaving action, the component particles of the ball must be rounded respectively;

(3) In order to prevent reduction of the contact pressure and production of cracks, the ball component particles must be densely aggregated;

(4) In order to prevent a shaving action, the pore diameter of the porous area (hereinafter referred to as voids) produced between the component particles must be small;

(5) Recently, wherein water based ink has come to be much used in place of oil based ink, a ball component material must especially be corrosion resistant;

(6) The ball component material must have a high affinity for ink.

The above and many other rigid conditions are demanded from balls used in ball-point pens.

However, balls made of cemented carbide, hardened stainless steel, ruby, etc. in conventional use cannot satisfy all the aforestated conditions but various improvements have been made over the balls. No solution has been given to problems such as a so-called "ball sunk" (sinking of the ball into the ball seat side), "nonuniformity in writing line thickness" (a sudden supply of much ink in various points of writing line to make the thickness of the line irregular), "dripping" (trickling down of much ink at the initial time of writing), "ball break" (breaking of the ball during writing), etc.

On the other hand, a ball made of ruby is not only high in the cost of material but also takes time and labor for machining and is high in the cost of production. In addition thereto, because it is monocrystalline, such ball offers, in point of strength, the disadvantage that it tends to crack along the axis of crystal.

SUMMARY OF THE INVENTION

After various studies and experiments have been made in an attempt to obtain a material having characteristics sufficient for use in a ball of a ball-point pen capable of being used under the rigid conditions described above, the present inventors have found that nonoxide ceramic materials such as silicon nitride ($Si_3N_4$) and silicon carbide (SiC) are adaptable for the ball and have worked out this invention.

A detailed description will now be given of the invention with reference to the accompanying drawing illustrating preferred embodiments of the invention.

BRIEF DESCRIPTION OF THE DRAWING

A sole FIGURE of the drawing is a graphic representation illustrating a relation between an average pore diameter of each of the voids of the ball of the invention and a writing distance and flow rate of ink to the ball.

DETAILED DESCRIPTION OF THE PREFERRED EMBODIMENTS

Figure 1:
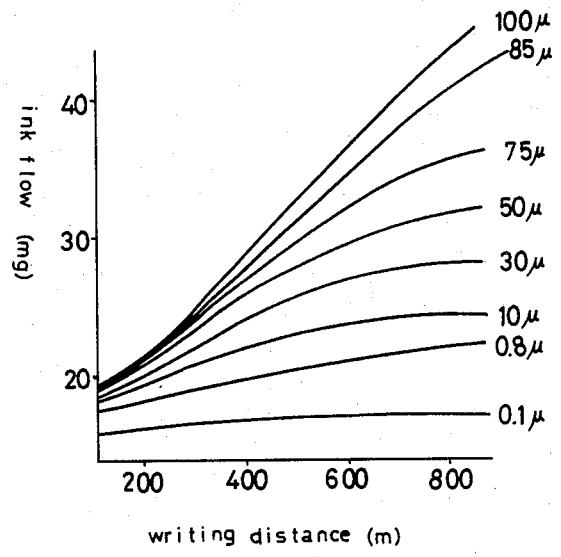

The invention is described with reference to silicon nitride ($Si_3N_4$) representative of a nonoxide ceramic.

A sintered body of silicon nitride is superior not only in high temperature resistance and heat shock resistance but also in wear resistance and chemical resistance such that the body has come to be used in various fields of industry. But silicon nitride itself is strong in covalent bonding property and is difficult to sinter, and accordingly it has become an important factor to add an additional sintering aid to the silicon nitride material.

An example of a silicon nitride component used in the embodiments of the invention is as follows:

$Si_3N_4$=74.0%
FeSi=6.0%
Fe=1.5%
$Fe_2O_3$=11.5%

To the silicon nitride compound above was added a metallic oxide such as MgO as a sintering aid and the product thus obtained was used for a sintering material. A suitable amount of various binders was added to the sintering material and shaped to a configuration of a ball of a desired ball diameter. Thereafter, the ball shaped thus was sintered in the temperature range of 1400°–1700° C. in an atmosphere of nitrogen gas. The sintered body thus obtained consists essentially of $\beta$-$Si_3N_4$ as a matrix, unaltered ferrosilicon, and a metallic oxide left in the form of crystals or noncrystals which are produced by oxidation during a sintering step. Such sintered body was ground to a ball having a specified diameter, sphericity and a surface state.

When on the other hand a ball was made of silicon carbide, a nonoxide ceramic, a suitable amount of sintering aid and binder was added to a silicon carbide material, and then the material was filled in a specified mold and formed, and was finally sintered in a nonoxide atmosphere. The resulting silicon carbide sintered body was ground to obtain a ball having a specified diameter, sphericity and a surface state. Other nonoxide ceramics such as SIALON (a solid solution of aluminum oxide and silicon nitride, as described in U.S. Pat. No. 3,960,581 to Cutler) and aluminum nitride were also used by adding a binder suitable to each of the ceramics, sintering the material thus obtained in a suitable atmosphere and sintering temperature, and grinding the material in a similar manner to produce a ball.

It is observed that there are produced a plurality of voids of indefinite shape in the ball thus obtained, particularly on the surface of the ball. The voids are those voids inherent in ceramic itself constituting the ball. Accordingly, the pore diameter of each of the voids is determined upon the temperature at which ceramic is sintered and upon the rate of material filled in the mold before sintering. But the smallness and largeness of average pore diameter of each of a plurality of voids present particularly on the surface of the ball have very much to do with the wear (shaving) of a ball seat, namely the amount of ball sinking and the amount of ink flow. It has been found that the voids each having a suitable average pore diameter provides a writing characteristic which assures constant and improved running of ink. As a result, balls made of silicon nitride and silicon carbide and having voids each different in average pore diameter were manufactured and a relation between writing distance and the amount of ball sunk was measured to show the results listed below. Incidentally, a ball seat made of brass was used.

TABLE I

| | | (Amount of ball sunk:μm) writing distance (m) | | | | |
|---|---|---|---|---|---|---|
| mean pore diameter (μm) | | 500 | 600 | 900 | 1200 | 1500 |
| Silicon nitride ball | 100 | 10 | 11 | 12 | 15 | 18 |
| | 75 | 8 | 8.5 | 9 | 10 | 10.5 |
| | 50 | 5 | 6 | 7 | 7.5 | 8 |
| | 30 | 3.5 | 4 | 4.5 | 5 | 6.5 |
| | 10 | 3 | 4 | 4.5 | 5 | 6 |
| | 1 | 0.5 | 0.8 | 0.9 | 1.1 | 1.2 |
| | 0.1 | 0.2 | 0.3 | 0.6 | 0.9 | 1.1 |
| | 0.08 | 0.1 | 0.2 | 0.5 | 0.6 | 0.8 |

TABLE II

| | | writing distance (m) | | | | |
|---|---|---|---|---|---|---|
| mean pore diameter (μm) | | 500 | 600 | 900 | 1200 | 1500 |
| Silicon carbide ball | 100 | 5 | 8 | 10 | 18 | 20 |
| | 75 | 4 | 6 | 10 | 11 | 12 |
| | 50 | 3 | 5 | 7 | 9 | 10 |
| | 30 | 3 | 3.5 | 5 | 7 | 9 |
| | 10 | 2 | 3 | 3.5 | 4 | 5 |
| | 1 | 0.5 | 0.7 | 0.9 | 1 | 1.1 |
| | 0.1 | 0.3 | 0.5 | 0.7 | 0.8 | 1.0 |
| | 0.08 | 0.2 | 0.3 | 0.5 | 0.7 | 0.8 |

It has become apparent from the measured values that both the silicon nitride ball and the silicon carbide ball increase the amount of a ball sunk by the ball seat being shaved in approximate proportion to a writing distance as the average pore diameter of each of a plurality of voids particularly on the surface portion of the ball becomes larger. When the average pore diameter exceeds 75 μm, the amount of ball sunk suddenly increases.

As is apparent from a graphical chart showing on the basis of the measured values a relation between writing distance and the amount of ink flow for each average pore diameter of respective voids in silicon nitride ball and in silicon carbide ball, the use of balls respectively having voids 10, 30, 50 and 75 μm in average pore diameter does not provide so much increased amount of ink flow even if the writing distance is great, However, such balls having an average pore diameter of 85 and 100 μm respectively is suddenly increase the amount of ink flow when the writing distance amounts to more than about 600 m.

As a result, it has been found that when the amount of ink flow exceeds as much as 60 mg, "nonuniformity in writing line thickness" and "dripping" occur in writing, and the ball suddenly deteriorates in writing characteristic. It has already been apparent that the rate of ink flow and ball sinking are substantially in direct proportion to each other.

From the above results it will be most desirable for each of silicon nitride and silicon carbide balls to have voids each having an average pore diameter in the range of 0.1–50 μm.

The reason is that a ball of less than 10 μm in average pore diameter of the voids therein is superior in characteristic but the production technique of such ball voids become more difficult in proportion to a reduction in pore diameter.

The ink in a ball-point pen flows from an ink reservoir through the space between a ball seat and a ball and is transferred from the ball surface to a writing surface. As described, when the ball surface contains voids of less than 75 μm, at least on the ball surface, such voids function well to satisfactorily supply ink. Also, because the presence of such voids on the ball surface makes it possible to obtain a suitable friction factor with respect to the writing paper surface, the ball-point pen has greatly been improved in initial writing characteristic. Moreover, the presence of such voids improves the affinity of the ball with ink in a substantial degree. Accordingly, it is experimentally demonstrated that a ball having voids each having an average pore diameter of more than about 0.1 μm functions better than a ball having voids each having an exceedingly small average pore diameter.

When the ball is less than 0.1 μm in pore diameter, it provides a small amount of ink in writing such that words written become light in color and sometimes become blurred.

The Rockwell hardness of the sintered body of silicon nitride and silicon carbide is about 90, very hard, and the heat expansion coefficient is also as small as $2.4–4.0\times10^{-6}/°C$. Accordingly, there is not only no possibility of the ball itself getting worn but also no change in writing characteristic due to temperature change.

As described above, the ball of the ball-point pen provided by the invention is highly useful in that it is superior in affinity with ink and is excellent in corrosion resistance. The present inventive ball point pen ball also has superior initial writing performance and in addition, wear of the ball seat is low. Thus the use of a pen having such a ball does not bring about "ink dropping", "ink dripping" or "nonuniformity in writing line thickness" but provides constant writing performance over a long time.

What is claimed is:

1. A ball-point pen ball consisting essentially of sintered silicon carbide, the ball having a plurality of surface voids, said voids having an average diameter in the range of 0.1 μm to 75 microns inclusive so as to produce a uniform written line while in use.

2. A ball-point pen ball consisting essentially of sintered silicon carbide, the ball having a plurality of surface voids, said voids having an average diameter in the range of 0.1 μm to 50 μm inclusive, so as to produce a uniform written line while in use.

3. A ball-point pen ball according to claim 1, wherein the voids are formed by a sintering process.

4. A ball-point pen ball according to claim 2, wherein the voids are formed by a sintering process.

* * * * *